United States Patent [19]

Dubach

[11] Patent Number: 4,887,746

[45] Date of Patent: Dec. 19, 1989

[54] TWO-PIECE SCREW CLOSURE FOR CONTAINERS

[75] Inventor: Werner F. Dubach, Maur, Switzerland

[73] Assignee: The Procter & Gamble Company, Cincinnati, Ohio

[21] Appl. No.: 108,242

[22] Filed: Oct. 13, 1987

[30] Foreign Application Priority Data

Oct. 14, 1986 [CH] Switzerland ..... 04086/86

[51] Int. Cl.[4] ..... B67D 5/06

[52] U.S. Cl. ..... 222/519; 222/153; 222/568; 222/571

[58] Field of Search ..... 222/153, 519–521, 222/571–572, 568; 215/252

[56] References Cited

U.S. PATENT DOCUMENTS

| | | | |
|---|---|---|---|
| 2,587,344 | 2/1952 | Livingstone | 222/571 X |
| 3,010,619 | 11/1961 | Gronemeyer et al. | 222/521 |
| 3,981,421 | 9/1976 | McDowell, Jr. et al. | 222/521 |
| 4,133,462 | 1/1979 | Lindstrom | 215/252 X |
| 4,497,422 | 2/1985 | Klees | 222/519 X |
| 4,503,986 | 3/1985 | Nixdorff et al. | 215/252 |
| 4,605,135 | 8/1986 | Ryder | 222/153 X |
| 4,690,304 | 9/1987 | Morel | 222/521 X |

FOREIGN PATENT DOCUMENTS

| | | | |
|---|---|---|---|
| 10437/32 | 12/1832 | Australia | 222/520 |
| 2456931 | 8/1976 | Fed. Rep. of Germany | 222/153 |
| 2709665 | 1/1979 | Fed. Rep. of Germany | 222/520 |

*Primary Examiner*—Joseph J. Rolla
*Assistant Examiner*—Steven M. Reiss
*Attorney, Agent, or Firm*—R. C. Witte; T. H. O'Flaherty; J. V. Gorman

[57] ABSTRACT

A two piece screw closure for containers is disclosed. A removable guarantee band is provided to prevent tampering with the contents of the container before the first use. The closure has a spout equipped lid which can be turned from the closed position to the open or pouring position which are located 180° apart, following removal of the guarantee band. The base is affixed to the container neck and has a plug projecting outwardly which coacts with a depending annular wall on the lid to seal the container when the lid is in the closed position. Flow-through openings in the base adjacent the plug permit dispensing the contents through the spout.

12 Claims, 5 Drawing Sheets

Fig. 1
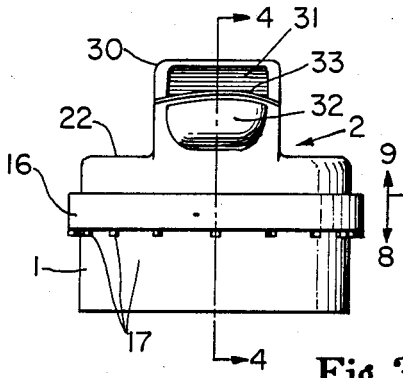
Fig. 2
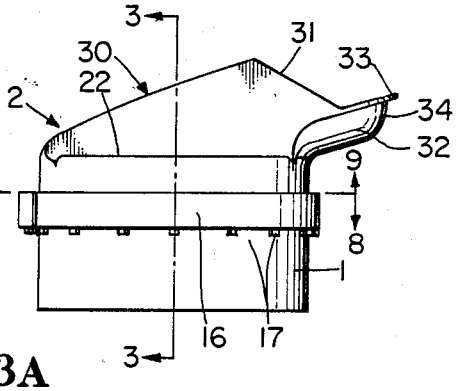
Fig. 3A
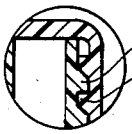
Fig. 3
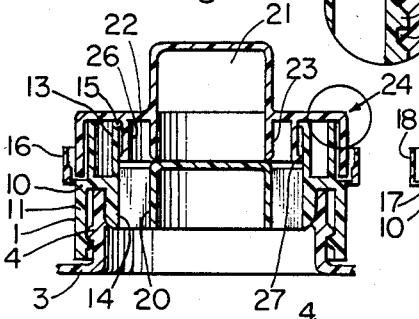
Fig. 4
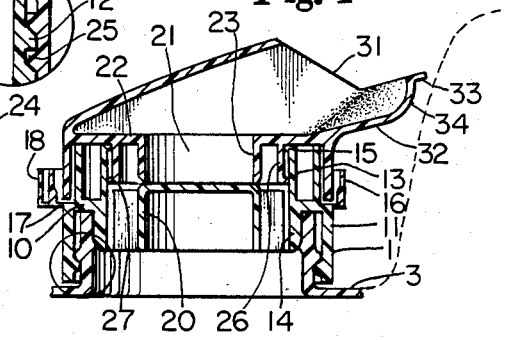
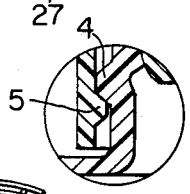
Fig. 4A
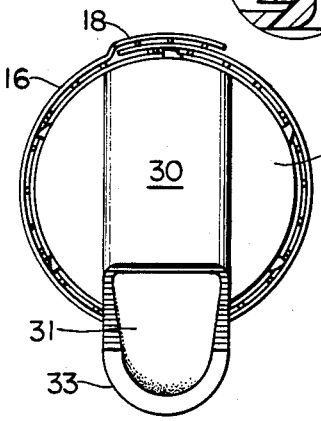
Fig. 5

TWO-PIECE SCREW CLOSURE FOR CONTAINERS

FIELD OF THE INVENTION

The present invention relates to a two-piece screw closure for containers, in particular canisters, consisting of a lower part which is connected to the container neck and has a sealing plug and at least one through-flow opening made peripherally thereto, and a screw lid with a pouring opening.

BACKGROUND OF INVENTION

Closures of the type mentioned at the beginning are widespread, in particular for plastic containers for free-flowing cosmetics. Although diverse embodiments are known, they all have certain identical features. The lower part is fixed in or on the container neck and has a sealing plug. Around the periphery of the sealing plug, generally several passage openings are made in the lower part. Both the screw lid and the lower part each have an annular wall, and these annular walls are directed towards one another, rest against one another concentrically and in sealing manner and act as a mechanical face seal and thus prevent the container contents reaching the thread.

The central sealing plug protrudes above the side walls of the lower part and, in the closed position, comes into alignment with the cap surface.

All these closures are suitable only for relatively small containers in which the sealing plug is of the order of 1 to 3 mm. For larger dimensions the known closures of the type mentioned at the beginning are not suitable. On the one hand, this is because the construction described above leads to an unsightly and unwieldly overall height, and on the other hand because, in the case of large dimensions, the residues left behind at the sealing plug would be too great and would contaminate the screw lid. In the case of smaller quantities and in particular where used on containers containing cosmetics, this is not important, for the small residue can be wiped off with a finger or a cotton wool ball. In larger containers, however, such a solution is not suitable. Here, greater allowance must also be made in particular for the fluidic conditions. Directed pouring also pertains to the fluid conditions. Especially in large containers, directed pouring represents an important problem, in particular as long as the container is still relatively full.

BRIEF SUMMARY OF THE INVENTION

The object of the present invention is therefore to create a closure which is suitable for larger closure dimensions, does not bring about any external contamination of the screw lid when in use and makes optimum allowance for the fluidic conditions.

The invention is a two-piece closure for containers having a lower part which is connected to the container neck and has a centrally located sealing plug with a pour-through opening located outside of the sealing plug. The top portion is a screw lid with a pouring opening located above the sealing plug and radially extending to a pouring spout. By turning the upper screw lid with respect to the lower portion an annular wall is raised off of the sealing plug, allowing the fluid content of the container to be poured through the spout. By turning the screw lid in the opposite direction, the annular wall of the screw lid contacts the sealing plug, closing the container.

BRIEF DESCRIPTION OF DRAWINGS

FIG. 1 is a front elevational view of an exemplary embodiment of the screw closure of the present invention;

FIG. 2 is a side view of the embodiment of FIG. 1;

FIG. 3 is a fragmentary vertical sectional view taken alcong line 3—3 of FIG. 2 when the screw closure is mounted on a container;

FIG. 3*a* is an enlarged detail of the vertical sectional view of FIG. 3 showing the interacting threads securing the lid and lower part of the closure of FIG. 1;

FIG. 4 is a fragmentary vertical sectional view taken along line 4—4 of FIG. 1 when the screw closure is mounted on a container;

FIG. 4*a* is an enlarged detail of the vertical sectional view of FIG. 4 showing the manner in which the lower part of the closure of FIG. 1 is affixed to the container;

FIG. 5 is a top plan view of the closure;

DETAILED DESCRIPTION OF THE INVENTION

Figure 7A:
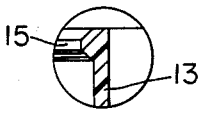
FIG. 7A is an enlarged detail of the vertical sectional view of FIG. 7 showing the annular beading of the inner wall.
Figure 7:
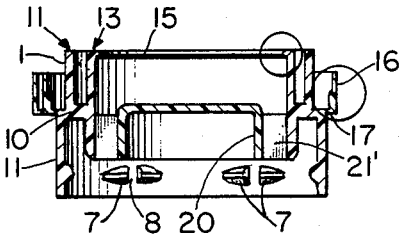
FIG. 7 is a vertical sectional view taken along line 7—7 of FIG. 6.
Figure 10:
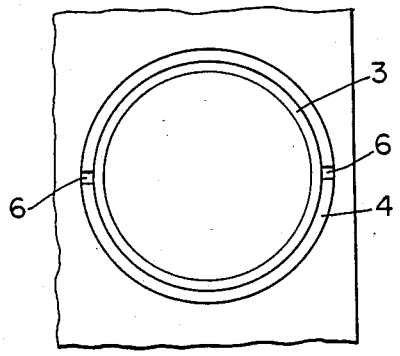
FIG. 10 is a top plan view of the container neck.

The closure consists of two separate parts: a lower part 1 and a screw lid 2, as can be seen most clearly in FIGS. 3 and 4 by the different hatching. The lower part 1 is fixed onto the container neck 3. The lower part 1 can be fixed in any known manner, as shown in FIG. 4A by a positively locking connection by means of an annular beading 4 or several snap-in projections on the container neck, with corresponding shaped means 5 on the closure part. These means only positionally fix the lower part 1 and the container neck 3 relative to one another vertically or in the withdrawal direction. For the closure according to the invention, however, exact fixing is also desired in the rotary direction. This can be effected by one or more elevations or depressions in the container neck 3 in which matching elements of the lower part engage. In the preferred embodiment shown according to FIG. 10, the container neck 3 is provided with an annular beading 4. Two vertical orientation ribs 6 are arranged diametrically opposite one another. In FIG. 7 it can be seen that elongated projections 7 which have a recess 8 are integrally formed on the lower part 1. The width of the recesses 8 corresponds to the thickness of the orientation ribs 6. If the projections 7 therefore grip on the one hand beneath the annular beading 4 and on the other hand around the orientation ribs 6 of the container neck 3, the lower part 1 of the screw closure is held exactly in position on the container in every direction.

As shown in FIG. 7 the lower part 1 is of double-walled design. The outer and inner vertical annular walls, which are concentric to one another, are connected to one another via a horizontal connecting wall. The wall parts located beneath the connecting wall 10, located at an intermediate level, are used for connecting to the container neck 3; the marginal parts located above the connecting wall are used for connecting to the screw cap 2. For this purpose, the outer wall 11, in the area beneath the connecting wall 10, has the elongated projections 7 already described and, in the area above the connecting wall 10, an external thread 12, as shown in FIG. 3A. Referring to FIGS. 3 and 4, beneath the connecting wall 10, the cantilevered inner wall 13 acts as an annular sealing lip 14 which rests in sealing manner against the inner wall of the container neck 3. The tightness can be increased by additional, known, annular, small sealing beadings (not shown). In FIG. 7 the connecting wall 10, the cantilevered inner wall 13 is cantilevered and rises to the same level as the outer wall 11 and is used for sealing between the lower part 1 and the screw lid 2. As shown in FIG. 7A, the inner wall 13 is provided with an annular beading 15 which is directed inwards and, as will be described later, acts as a mechanical face seal.

Figure 7B:
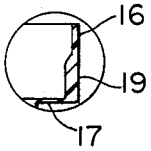
FIG. 7B is an enlarged detail of the vertical sectional view of FIG. 7 showing the vertical ribs of the guarantee band.

Displaced outwards relative to the outer wall 11, a guarantee band 16 surrounds the lower part. This guarantee band 16 is connected to the outer wall 11 by means of a plurality of connecting bridges 17 having predetermined breaking points. A certain part of the guarantee band 16 is overlapping and thus forms a tear-off end 18 which can additionally be serrated. FIG. 7B shows to an enlarged scale that the guarantee band is designed with vertical check ribs 19 directly radially inwards, which makes it impossible to open the screw lid 2 before the guarantee band is destroyed.

Figure 6:
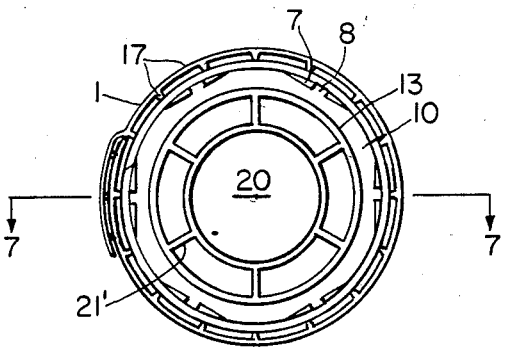
FIG. 6 is a bottom plan view of the closure.
Figure 8:
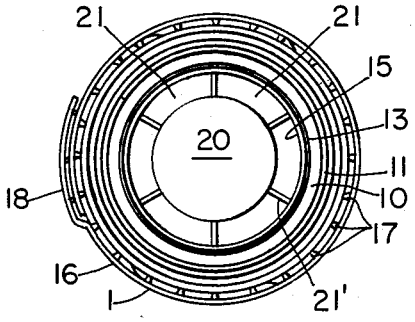
FIG. 8 is a horizontal sectional view taken along line 8—8 of FIG. 2.

The sealing plug 20 is arranged centrally in the lower part 1. It can be clearly seen in FIGS. 6 and 8 that the plug 20 is held in the lower part 1 by means of webs 21. As shown in FIGS. 3 and 4, the surface of the sealing plug 20 lies below the upper margins of the two walls 11 and 13 and therefore does not come into the area of the screw lid surface. Nevertheless, it is useful if the residual quantity of the container contents remaining on the sealing plug 20 flows back into the container. Provision is therefore made in a variant for the surface of the sealing plug to be of arched configuration towards the screw lid. In another embodiment, provision is furthermore made for the sealing plug 20 to taper conically towards the lid. This permits improved sealing between the annular wall 23 of the lid 2 and the sealing plug 20 of the lower part 1.

Figure 9:
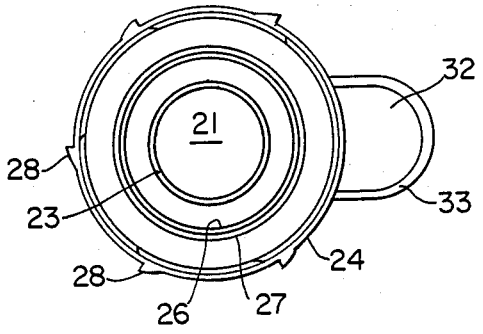
FIG. 9 is a horizontal sectional view taken along line 9—9 of FIG. 2.

The embodiment of the screw lid illustrated in FIG. 5 will be discussed in detail. With reference to FIG. 9, the screw lid 2 has a cylindrical basic form and a centric pouring opening 21. Referring to FIGS. 3 and 4, an annular wall 23 surrounding the pouring opening protrudes from the actual screw cap surface 22. This annular wall 23 is directed into the screw lid. If the screw lid 2 is fully screwed down, the lower edge of the annular wall 23 rests in sealing manner on the sealing plug 20. The screw lid 2 is also made double-walled. The outer side wall 24 forming the outer contour of the screw lid is provided with an internal thread 25 which can be seen in FIG. 3A. The internal thread 25 is adapted to the external thread 12 on the outer wall 11 of the lower part 1 and is used for turning the screw lid 2 from the closed position into the open position. In order to achieve as large a through-flow opening as possible between the sealing plug 20 and the annular wall 23, the threads 12 and 25 are designed with a large pitch and are made 3-start. So that the thread, despite the large pitch, is nevertheless still self-locking, a thread with a trapezoidal cross-section has been selected.

A second annular wall 26 running concentrically to the first annular wall 23 around the pouring opening 21 rests in sealing manner against the inside of the inner wall 13 of the lower part 1. These two walls 13 and 26 resting against one another together form a type of mechanical face seal. During the relative rotation of the screw lid 2 and the lower part 1, the two said walls 13 and 26 slide on one another in a tangential and axial direction. To increase the tightness, the second annular wall 26 is likewise provided with an annular beading 27. However, this annular beading 27 additionally acts with the annular beading 15 of the inner wall 13 as a safety feature to prevent the screw cap from being twisted off.

As shown in FIG. 9, the outer wall 24 of the screw lid 2, at its lower margin, has several outwardly directed, saw-tooth-shaped elevations 28 which interact with the check ribs 19 of the guarantee band 16. Although they permit the screw lid 2 to be tightened onto the lower part 1 without destroying the connection between the guarantee band 16 and the lower part 1, they prevent the screw lid from being opened for the first time before the guarantee band is destroyed.

As shown in FIGS. 1 and 2, a spout 30 rising relative to the lid surface 22 extends beyond the pouring opening 21 diagonally over the screw lid 2. This pouring spout 30 points radially outwards and upwards. The lip 32 of the spout 30 with the separation edge 33 is prominent. The configuration of the lip 32 and the separation edge 33 has developed from fluidic considerations and tests. The essential features are described below. The lip 32 and also the separation edge 33, in the assembled condition of the closure and in the normal position of the container, slope downwards towards the pouring opening 21 in the screw lid surface 22. In the transition area between the separation edge 33 and the section of the lip 32 running towards the lip surface there is an area 34 arched towards the pouring opening 21 by about 90°. The sharp separation edge 33 permits drip-free pouring from the first to the last moment.

The specially shaped pouring lip 32 forms a hollow 31 which has two important functions. During pouring, the hollow 31 fills visibly so that the user knows exactly when the medium flows out. At the end of the pouring operation, the flow separates exactly at the separation edge and the remaining quantity located on the edge is pulled along into the hollow by the return flow, which flows quickly in the area of the arched portion even at minimum quantities. The quantity located in the hollow of the lip is held together by the surface tension of the medium and flows virtually completely as a body back into the container through the pouring opening 21.

Figure 11:
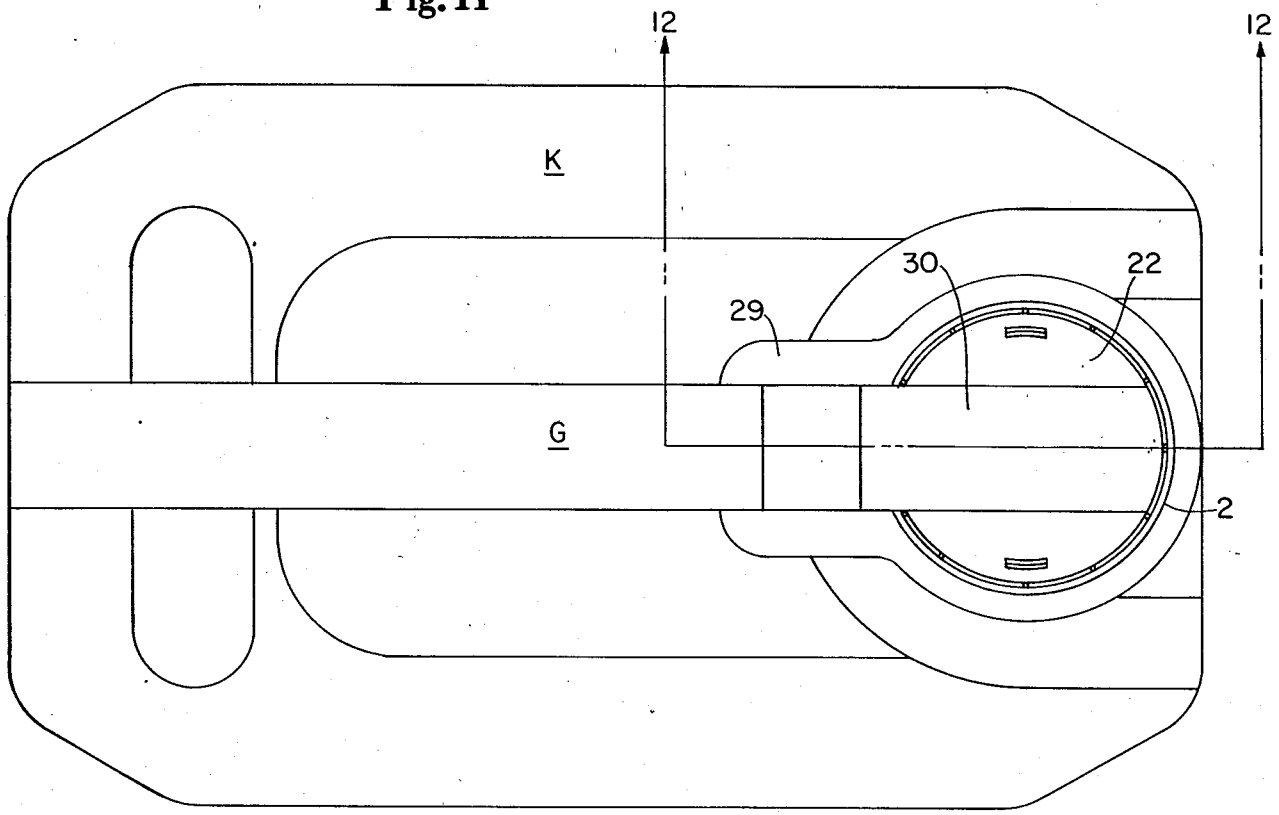
FIG. 11 shows another embodiment of the screw closure of the present invention mounted on a canister-shaped container with a carrying handle.
Figure 12:
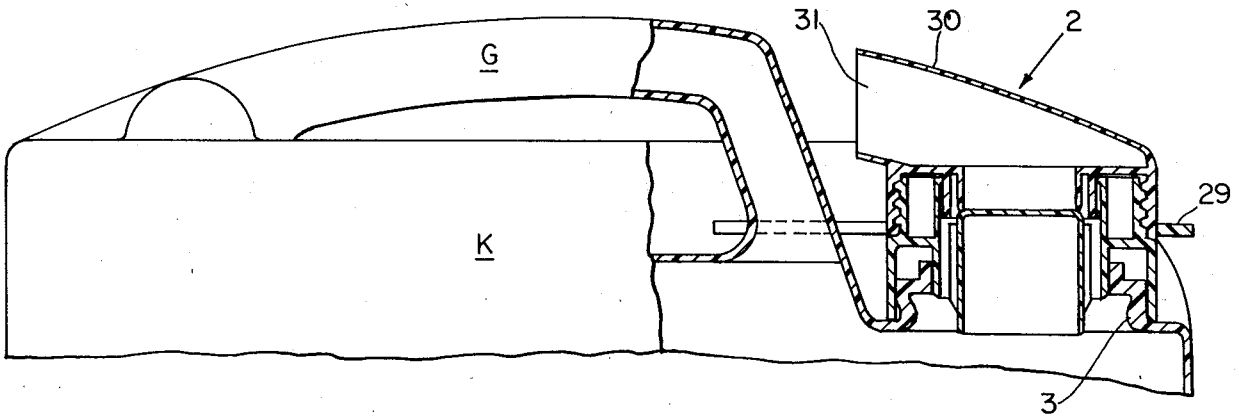
FIG. 12 shows a fragmentary partial vertical section taken along line 12—12 of FIG. 11.

If the container is a canister, such as shown, for example, in FIGS. 11 and 12, additional embodiments result for the screw closure. Thus the guarantee band can be replaced by a guarantee securing element in the form of a guarantee fork. The canister-shaped container K must have a carrying handle G for this purpose and the container neck must be arranged on the extension of the longitudinal axis of the carrying handle G. Under these preconditions, a guarantee fork 29 can be placed on the screw lid 2, which guarantee fork 29, like the guarantee band 16 described above on the lower part 1, is integrally formed on the screw lid via connecting bridges having predetermined breaking points. The guarantee fork 29 grips around the handle G on two sides. Only after the guarantee fork 29 has been torn off from the screw lid can the latter be turned.

A further special feature is that the spout 30 is shaped in such a way that it forms the continuation of the carrying handle G.

Although the closure according to the invention is especially advantageous for application on a canister-shaped container, it can be attached in principle to every other container having a container neck. However, it is especially expedient for larger containers from which larger quantities have to be discharged.

Especially in large containers, it is an advantage, not to be overlooked, if the pouring opening can be turned in the desired pouring direction, as is possible with the spout of the closure according to the invention. In this way, pouring out the contents of a full container is considerably improved without the risk of the container contents driping onto the container.

In the example shown, the lead-through openings in the lower part 1 are formed by the intermediate spaces between the webs 21'. But of course the sealing plug 20 can also be connected via a more or less closed wall to the inner wall 13 of the lower part and be interrupted only by one or more lead-through openings arranged around the periphery of the sealing plug 20. However, the solution shown is to be preferred for many applications.

The lower is advantageously made of a polypropylene which is dimensionally very stable and has a high strength, whereas a softer material is to be preferred for the screw lid, such as, for example, a polyethylene.

What is claimed is:

1. Two-piece screw closure for containers comprising a lower part which is connected to the container neck and has a sealing plug and at least one lead-through opening made peripherally thereto, said lower part further comprising inner and outer concentric annular walls connected at a level intermediate the ends of both said inner and said outer concentric annular walls via a horizontal connecting wall, the ends of said inner annular wall being cantilevered therefrom and, said inner annular wall below said horizontal connecting wall being in sealing engagement with the inner wall of said container neck, said screw closure further comprising a screw lid with a pouring opening, and that extending from the pouring opening in the screw lid surface is an annular wall which protrudes downwardly from said screw lid and is directed towards the sealing plug and, an outer sidewall provided with an internal thread, whereby in the closed position of the closure, the annular wall of the screw lid rests in sealing manner on the sealing plug and that, extending over the pouring opening and diagonally over the screw lid a pouring spout with the screw closure at the same time being transferred from the sealing position into the open position by turning the screw lid from the closed position into the pouring position.

2. Screw closure according to claim 1, characterized in that the sealing plug is arched towards the lid.

3. Screw closure according to claim 1, characterized in that the pouring spout is provided with a lip having a separation edge and extends beyond the periphery of the lower part.

4. Screw closure according to claim 3, characterized in that the spout has an arched area which is directed downwards from the separation edge by approximately 90°towards the pouring opening, so that the separation edge and the section of the lip running towards the lid surface run approximately parallel.

5. Screw closure according to claim 1, characterized in that, by means of connecting bridges having predetermined breaking points, a guarantee band is arranged on the lower part with locking ribs which are directed radially towards the center and are positively engaged with elevations present on the screw lid and directed radially outwards.

6. Screw closure according to claim 1, characterized in that the outer concentric annular wall is designed with means for fixing to the container neck and provided with an external thread which conforms to the thread of the screw lid.

7. Screw closure according to claim 1, characterized in that the inner wall of the double-walled lower part above the connecting wall rests in sealing manner against a second annular wall in the screw lid, which annular wall runs concentrically to the annular wall about the pouring opening between the same and the outer wall of the screw lid so that the inner wall of the lower part and the second concentric annular wall of the screw lid together form a mechanical face seal.

8. Screw closure according to claim 7, characterized in that the upper part of the inner wall has an inwardly directed annular end beading and the second concentric annular wall in the screw lid has an annular end beading so that the two annular beadings form a safety feature to prevent the screw lid from being twisted off from the lower part.

9. Screw closure according to claim 1, characterized in that the interacting threads of the screw lid and the lower part are multi-start and have a pitch which brings the screw lid, by a rotation through 180°, from the closed position, into the fully open position.

10. Screw closure according to claim 1 for a container, with an orientation elevation or recess arranged on the container neck characterized in that a matching recess or elevation which guarantees an exact defined assembly position of the lower part of the closure on the container neck is arranged on the lower part of the closure.

11. Screw closure according to claim 1, characterized in that the lower part is made of polypropylene and the screw lid is made of polyethylene.

12. Screw closure according to claim 1, characterized in that the sealing plug tapers conically towards the lid.

* * * * *